US009450309B2

(12) United States Patent
Cooper

(10) Patent No.: US 9,450,309 B2
(45) Date of Patent: Sep. 20, 2016

(54) LOBE ANTENNA

(71) Applicant: Xi3, Inc., Salt Lake City, UT (US)

(72) Inventor: Henry Cooper, Fallbrook, CA (US)

(73) Assignee: XI3, Salt Lake City, UT (US)

( * ) Notice: Subject to any disclaimer, the term of this patent is extended or adjusted under 35 U.S.C. 154(b) by 0 days.

(21) Appl. No.: 14/292,708

(22) Filed: May 30, 2014

(65) Prior Publication Data

US 2014/0354485 A1 Dec. 4, 2014

Related U.S. Application Data

(60) Provisional application No. 61/829,151, filed on May 30, 2013.

(51) Int. Cl.
*H01Q 1/38* (2006.01)
*H01Q 13/08* (2006.01)

(52) U.S. Cl.
CPC ..... *H01Q 13/085* (2013.01)

(58) Field of Classification Search
CPC .... H01Q 1/38; H01Q 9/0407; H01Q 9/0421; H01Q 1/243; H01Q 5/0003
USPC ..... 343/700 MS, 795, 810, 816, 853, 793
See application file for complete search history.

(56) References Cited

U.S. PATENT DOCUMENTS 744,897 A 11/1903 Braun
2,270,314 A 1/1942 Kraus
3,921,177 A 11/1975 Munson
4,437,074 A 3/1984 Cohen et al.
4,814,777 A 3/1989 Monser
4,843,403 A 6/1989 Lalezari et al.
4,853,704 A * 8/1989 Diaz ..... H01Q 13/085 343/767
5,036,335 A 7/1991 Jairam
5,124,712 A 6/1992 Caille et al.
5,124,733 A 6/1992 Haneishi
5,142,255 A 8/1992 Chang et al.
5,534,880 A 7/1996 Button et al.
5,541,611 A 7/1996 Peng et al.
5,557,291 A 9/1996 Chu et al.
5,661,494 A 8/1997 Bondyopadhyay
5,845,391 A 12/1998 Bellus et al.

(Continued)

FOREIGN PATENT DOCUMENTS

CA 2244369 A1 1/1999
EP 2673834 A1 12/2013

(Continued)

OTHER PUBLICATIONS

Balanis, "Antenna Theory: A Review", Proc. IEEE, vol. 80, No. 1, Jan. 1992, pp. 7-23.

(Continued)

*Primary Examiner* — Huedung Mancuso
(74) *Attorney, Agent, or Firm* — David B. Tingey; Kirton McConkie

(57) ABSTRACT

A broadband antenna element formed of conductive material on a planar substrate is disclosed. The element has two lobes defining a cavity with declining in width from a widest to narrowest point to form a wideband antenna. Angled corners communicating with linear side edges along with stepped angles of the edges defining the cavity, enhance reception and transmission gain.

3 Claims, 1 Drawing Sheet

(56) References Cited

U.S. PATENT DOCUMENTS

| | | | | |
|---|---|---|---|---|
| 6,191,750 | B1 | 2/2001 | Bonebright | |
| 6,351,246 | B1 * | 2/2002 | McCorkle | H01Q 1/38 343/786 |
| 6,396,453 | B2 | 5/2002 | Amyotte et al. | |
| 6,512,488 | B2 * | 1/2003 | Schantz | H01Q 9/005 343/795 |
| 6,525,696 | B2 | 2/2003 | Powell et al. | |
| 6,552,691 | B2 | 4/2003 | Mohuchy et al. | |
| 6,603,430 | B1 | 8/2003 | Hill et al. | |
| 6,703,981 | B2 | 3/2004 | Meitzler et al. | |
| 6,724,346 | B2 | 4/2004 | Le Bolzer et al. | |
| 6,765,539 | B1 | 7/2004 | Wang et al. | |
| 6,806,845 | B2 | 10/2004 | Fund et al. | |
| 6,859,176 | B2 | 2/2005 | Choi | |
| 6,911,947 | B1 | 6/2005 | Cranor et al. | |
| 6,977,624 | B1 | 12/2005 | Szente et al. | |
| 7,057,568 | B2 | 6/2006 | Louzir et al. | |
| 7,064,729 | B2 | 6/2006 | Olson | |
| 7,176,837 | B2 * | 2/2007 | Sonoda | H01Q 1/38 343/700 MS |
| 7,180,457 | B2 | 2/2007 | Trott et al. | |
| 7,209,089 | B2 * | 4/2007 | Schantz | H01Q 13/10 343/787 |
| 7,245,266 | B1 | 7/2007 | Szente et al. | |
| 7,280,082 | B2 | 10/2007 | Theobold et al. | |
| 7,327,315 | B2 * | 2/2008 | Starkie | H01Q 5/00 343/700 MS |
| 7,403,169 | B2 * | 7/2008 | Svensson | H01Q 13/085 343/767 |
| 7,443,350 | B2 * | 10/2008 | Gaucher | H01Q 1/2266 343/700 MS |
| 7,450,077 | B2 | 11/2008 | Waterhouse et al. | |
| 7,538,739 | B2 | 5/2009 | Tao | |
| 7,557,755 | B2 | 7/2009 | Han et al. | |
| 7,764,236 | B2 | 7/2010 | Hill et al. | |
| 7,768,470 | B2 * | 8/2010 | Qin | H01Q 1/36 343/700 MS |
| 8,059,054 | B2 * | 11/2011 | Mohammadian | H01Q 9/28 343/700 MS |
| 8,063,841 | B2 | 11/2011 | Peng et al. | |
| 8,138,985 | B2 | 3/2012 | Cooper | |
| 8,144,068 | B2 | 3/2012 | Thevenard et al. | |
| 8,149,172 | B2 | 4/2012 | Lu et al. | |
| 8,531,344 | B2 * | 9/2013 | Ayatollahi | H01Q 9/28 343/793 |
| 8,564,491 | B2 | 10/2013 | Peng | |
| 2003/0011525 | A1 | 1/2003 | Sanad | |
| 2003/0218571 | A1 | 11/2003 | Yoon et al. | |
| 2004/0214543 | A1 | 10/2004 | Osone et al. | |
| 2004/0217911 | A1 | 11/2004 | Le Bolzer et al. | |
| 2005/0078042 | A1 | 4/2005 | Chua | |
| 2005/0099343 | A1 | 5/2005 | Asrani et al. | |
| 2005/0270243 | A1 | 12/2005 | Caimi et al. | |
| 2006/0181471 | A1 | 8/2006 | Kim et al. | |
| 2007/0018895 | A1 | 1/2007 | Bolin | |
| 2007/0046393 | A1 | 3/2007 | Quan et al. | |
| 2007/0096919 | A1 | 5/2007 | Knadle, Jr. et al. | |
| 2007/0258676 | A1 | 11/2007 | Windover | |
| 2008/0191946 | A1 | 8/2008 | Gustaf | |
| 2008/0292035 | A1 | 11/2008 | Chang | |
| 2009/0153410 | A1 | 6/2009 | Chiang et al. | |
| 2009/0251377 | A1 | 10/2009 | Peng et al. | |
| 2010/0141551 | A1 | 6/2010 | Peng | |
| 2010/0315303 | A1 | 12/2010 | Kearney et al. | |
| 2011/0043301 | A1 | 2/2011 | Huettner | |
| 2011/0057852 | A1 | 3/2011 | Holland et al. | |
| 2011/0074649 | A1 | 3/2011 | Isom et al. | |
| 2011/0128199 | A1 | 6/2011 | He et al. | |
| 2011/0175787 | A1 | 7/2011 | Malak et al. | |
| 2011/0235755 | A1 | 9/2011 | Yang et al. | |
| 2012/0071214 | A1 | 3/2012 | Ash, Jr. et al. | |
| 2012/0146869 | A1 | 6/2012 | Holland et al. | |
| 2012/0169554 | A1 | 7/2012 | Behdad et al. | |
| 2012/0200468 | A1 | 8/2012 | Cooper et al. | |
| 2012/0200469 | A1 | 8/2012 | Cooper et al. | |
| 2012/0200470 | A1 | 8/2012 | Cooper et al. | |
| 2012/0206303 | A1 | 8/2012 | Desclos et al. | |
| 2012/0281162 | A1 | 11/2012 | Chen et al. | |
| 2012/0299786 | A1 | 11/2012 | Anguera et al. | |
| 2012/0313832 | A1 | 12/2012 | Pazin et al. | |
| 2012/0320506 | A1 | 12/2012 | Bentz et al. | |
| 2013/0035050 | A1 | 2/2013 | Gao et al. | |
| 2013/0169487 | A1 | 7/2013 | Liang et al. | |
| 2013/0187816 | A1 | 7/2013 | Chung et al. | |
| 2014/0055315 | A1 | 2/2014 | Cooper et al. | |
| 2014/0097997 | A1 | 4/2014 | Chang | |
| 2014/0118210 | A1 | 5/2014 | Cooper et al. | |
| 2014/0118211 | A1 | 5/2014 | Cooper et al. | |
| 2014/0333497 | A1 | 11/2014 | Cooper | |
| 2014/0354485 | A1 | 12/2014 | Cooper | |
| 2015/0222008 | A1 | 8/2015 | Cooper | |
| 2015/0333394 | A1 | 11/2015 | Nash et al. | |
| 2015/0340768 | A1 | 11/2015 | Rucker et al. | |
| 2015/0349401 | A1 | 12/2015 | Nash | |
| 2016/0190702 | A1 | 6/2016 | Rucker et al. | |
| 2016/0191693 | A1 | 6/2016 | Zavala | |

FOREIGN PATENT DOCUMENTS

| | | | |
|---|---|---|---|
| FR | 2785476 | | 5/2000 |
| JP | 59005705 | A | 1/1984 |
| KR | 100703221 | B1 | 4/2007 |
| KR | 1020070062187 | A | 6/2007 |
| KR | 1020130095451 | A1 | 8/2013 |
| KR | 1020140089307 | | 7/2014 |
| RU | 2211509 | C2 | 8/2003 |
| RU | 2327263 | C2 | 6/2008 |
| RU | 2380799 | C1 | 1/2010 |
| RU | 2400876 | C1 | 9/2010 |
| WO | WO 98/20578 | A1 | 5/1998 |
| WO | WO 03/098732 | A1 | 11/2003 |
| WO | WO 2007/036607 | A1 | 4/2007 |
| WO | WO 2012/058753 | A1 | 5/2012 |
| WO | WO 2012/109392 | A1 | 8/2012 |
| WO | WO 2012/109393 | A1 | 8/2012 |
| WO | WO 2012/109498 | A1 | 8/2012 |
| WO | WO 2013/063335 | A1 | 5/2013 |
| WO | WO 2014/011943 | A1 | 1/2014 |
| WO | WO 2014/043401 | A1 | 3/2014 |
| WO | WO/2014/047211 | A1 | 3/2014 |
| WO | WO 2014/047567 | A1 | 3/2014 |
| WO | WO 2015/171963 | A1 | 11/2015 |
| WO | WO 2015/175550 | A1 | 11/2015 |
| WO | WO 2015/176064 | A1 | 11/2015 |
| WO | WO 2015/184469 | A2 | 12/2015 |
| WO | WO 2016/007958 | A2 | 1/2016 |
| WO | WO 2016/011076 | A1 | 1/2016 |
| WO | WO 2016/011181 | A1 | 1/2016 |

OTHER PUBLICATIONS

Sievenpiper D., et al., "Low-Profile, Four-Sector Diversity Antenna on High-Impedance Ground Plane", Electronics Letters, IEE Stevenage, GB, vol. 36, No. 16, Aug. 3, 2000, pp. 1343-1345.

* cited by examiner

LOBE ANTENNA

This application is a U.S. Non-provisional application of U.S. Provisional application No. 61/829,151 filed on May 30, 2013 all incorporated herein in entirety by this reference.

BACKGROUND OF THE INVENTION

1. Field of the Invention

The present invention relates to antennas for transmission and reception of radio frequency communications. More particularly, it relates to an antenna employing a single planar shaped antenna element which is especially well adapted for high definition television communications, as well as a wide number of other frequencies and the receipt and transmission of both vertical and horizontal polarized RF signals.

2. Prior Art

Antennas provide electronic communication for radios, televisions, and cellular telephones and have come to define the information age that we live in. When constructing a communications array such as an HDTV antenna broadcast site, or a wireless communications grid, the builder is faced with the dilemma of obtaining antennas that are customized by providers for the narrow frequency to be broadcast as well as polarization for various individual digital signals. Most such antennas are custom made using antenna elements to match the narrow band of frequencies and polarization to be employed at the site which can vary widely depending on the network and venue. The horizontal, vertical, or circular polarization scheme may be desired to either increase bandwidth ability from a single site and the potential number of connections.

External antennas generally take the form of large cumbersome conic or Yagi type construction and are placed outdoors either on a pole on the roof top of the building housing the receiver or in attic or the like of a building. These antennas are somewhat fragile as they are formed by the combination of a plurality of parts including reflectors and receiving elements formed of light weight aluminum tubing or the like having various lengths to satisfy the frequency requirements of the received signals and plastic insulators. The receiving elements are held in relative position by means of the insulators and the reflectors elements are grounded together.

Other antennas that are currently used are indoors antennas which are easy on the eyes but unacceptable for producing a good picture and sound. The most common and effective of these indoor antennas is the well known dual dipole type positioned adjacent to or on the television receiver and affectionately referred to as "rabbit ears". These antennas are generally ineffective for fringe area reception and are only effective for strong local signal reception. When low frequency signals reception is desired, the dipoles must be extended to their maximum length which makes the "rabbit ear" antenna susceptible to tipping over or interfering with or causing possible damage to any adjacent objects.

Cable systems are also currently used for delivering signals to television receivers. This system is highly successful for delivering high quality non-pixelating signals to a television receiver over a large range of frequencies. One of the strongest disadvantages to the cable signal delivery systems is the economic cost of installation and the periodic cost of the signal delivery to the user which can run as high as one hundred dollars monthly. Further, off air broadcast television at newer digital frequencies frequently has broadcast towers in different geographical locations and weaker signals than analog TV of the past. Consequently, receiving a signal with conventional Yagi antennas or indoor rabbit ears, is often unsuccessful yielding a disappointing video picture.

Satellite dishes with their accompanying accessories is another of the present methods of receiving television signals. This method is popular and successful for receiving signals from fixed in position satellites. Systems of this type require large diameter dishes generally in excess of six feet and ideally about twelve feet for receiving acceptable signal levels. Small dishes under two feet in diameter are presently unusable for all but the most powerful satellite transmitters. The acceptable sized dishes are ugly to view and because of size are hard to hide from sight. In addition the systems as they exist today are quite expensive and, therefore, not available to all who desire to view picture perfect television reception.

However, due to the problems and draw backs outlined above, as well as other problems that one skilled in the art will immediately recognize with existing antenna systems and structures, there is a continuing unmet need for an improved antenna radiator or element configuration for improved reception and transmission.

SUMMARY OF THE INVENTION

The device herein disclosed and described provides a solution to the shortcomings in prior art and achieves the above noted goals through the provision of an antenna element configured for reception and broadcast in a wideband fashion for digital television, WiFi, Bluetooth, and other frequencies.

The antenna element of the instant invention employs a planar antenna element formed by printed-circuit technology. The antenna is of two-dimensional construction forming generally what is known as a Vivaldi or planar horn antenna. The antenna is formed on a dialectic substrate of such materials as MYLAR, fiberglass, REXLITE, polystyrene, polyamide, TEFLON, fiberglass or any other such material suitable for the purpose intended. The substrate may be flexible whereby the antenna can be rolled up for storage and unrolled into a planar form for use. Or, in a particularly preferred mode of the device herein, it is formed on a substantially rigid substrate material in the planar configuration using a dialectic allowing for a vertical or horizontal disposition and reception and transmission from all directions.

The antenna element itself, formed on the substrate, can be any suitable conductive material, as for example, aluminum, copper, silver, gold, platinum or any other electrical conductive material suitable for the purpose intended. The conductive material forming the element is adhered to the substrate by any known technology.

In a particularly preferred embodiment, the planar antenna element is formed in the conductive planar material on a first side of the substrate currently between 2 to 250 mils thick through the formation of a void in the conductive material in the form of a horn having a curved or serpentine extension. The formed horn has the general appearance of a cross-section featuring two substantially lobe-shaped half-sections in a substantially mirrored configuration extending from a center to pointed tips positioned a distance from each other at their respective distal ends.

A cavity beginning with a large uncoated or unplated surface area of the substrate between the respective tips of the two lobes forms a mouth of the horn antenna and is substantially centered between the two round lobe end points on each lobe half-section of the antenna element. This formed cavity extends substantially perpendicular to a horizontal line running between the two distal tip points and then communicates with a tail portion which curves into the body portion of one of the lobe halves and extends away from the other half.

Along the cavity pathway, from the distal tip points of the element halves, the cavity narrows continually in its cross sectional area. The cavity is at a widest point between the two distal end points and narrows to a narrowest point. The cavity from this narrow point then extends to a tail portion which curves to extend to a distal end within the one half where it makes a short right angled extension from the centerline of the curving cavity. The area occupied by this tail section has a direct effect upon the antenna impedance and as such is adjusted for area for impedance matching purposes.

The widest point of the cavity between the distal lobe ends of the antenna element halves determines the low point for the frequency range of the element. The narrowest point of the cavity between the two halves determines the highest frequency to which the element is adapted for use.

The antenna element having linear parallel side edges extends below the lobe halves into a box-shaped end having right angled corners. The lobes and box-shaped end are formed as unitary conductive material surface area and provides a means for impedance matching as is often associated with antenna construction. One skilled in the art will immediately recognize how impedance matching relates to the relationship between the total surface area of the conductive material of the lobes and box-end to the area of the remaining uncoated substrate on the planar surface of the antenna.

On the opposite surface of the substrate from the formed antenna element, a feedline and feedpad extends from the area of the cavity intermediate the first and second leaf halves of the antenna element to the area of the additional conductive material below opposing lobes or half portions. The feedline passes through the substrate to a tap position to electrically connect with the antenna element which has the cavity extending therein to the distal end perpendicular extension.

At the bottom edge of the substrate the feedline connects to an input/output electrical connector port, such as a coaxial connector, to allow for engagement of transmission lines or the like. Those skilled in the art will appreciate that the electrical connector can be of any type and should therefor not be considered limited to a coaxial connector.

The location of the feedline connection, the size and shape of the feedpad, size and shape of the two opposing lobes of the antenna element, the cross sectional area of the cavity, and the size and shape of the box-shaped end below the lobe-like halves may be of the antenna designers choice for best results for a given use and frequency. However, because the disclosed antenna element performs so well, across such a wide bandwidth, the current mode of the antenna element as depicted herein, with the connection point shown, is especially preferred.

Of course those skilled in the art will realize that shape of the box shaped half-portions and size and shape of the cavity, and angles from the linear side edges toward the mouth of the horn, and the size and shape of the box-end surface area, may be adjusted to fine tune impedance matching, increase gain in certain frequencies or for other reasons known to the skilled, and any and all such changes or alterations of the depicted antenna element as would occur to those skilled in the art upon reading this disclosure are anticipated within the scope of this invention.

It must further be noted that although the present invention is portrayed as a single antenna element it is within the scope of the invention that the antenna be employed as an array of a such antenna elements either in a vertical disposition or horizontal disposition and positionable for either horizontal or vertical polarization of RF signals received and/or broadcast. Using the disclosed array of a plurality of antenna elements herein with each having two leaf-like shaped lobes, yields highly customizable antennas.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

DETAILED DESCRIPTION OF THE PREFERRED EMBODIMENTS OF THE INVENTION

Figure 1:
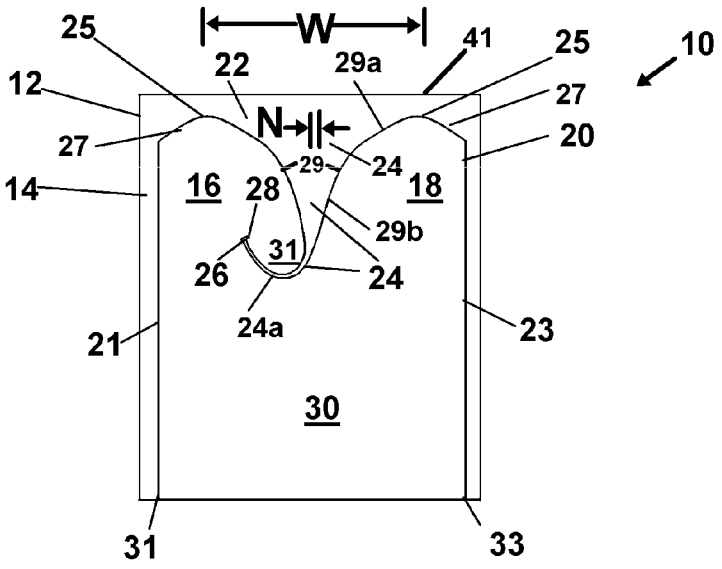
FIG. 1 depicts a front view of the antenna element having two opposing lobes or half portions having linear parallel side edges intersecting angled portions which communicate with respective endpoints defining a widest portion of a formed mouth.
Figure 2:
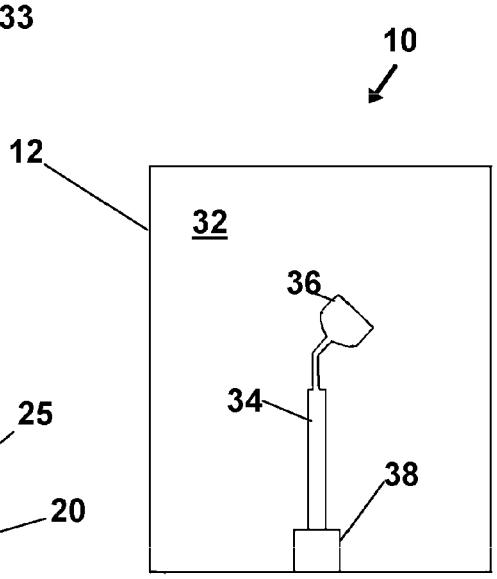
FIG. 2 shows a rear view of the antenna element showing the feedline, feedpad, and connector.
Figure 3:
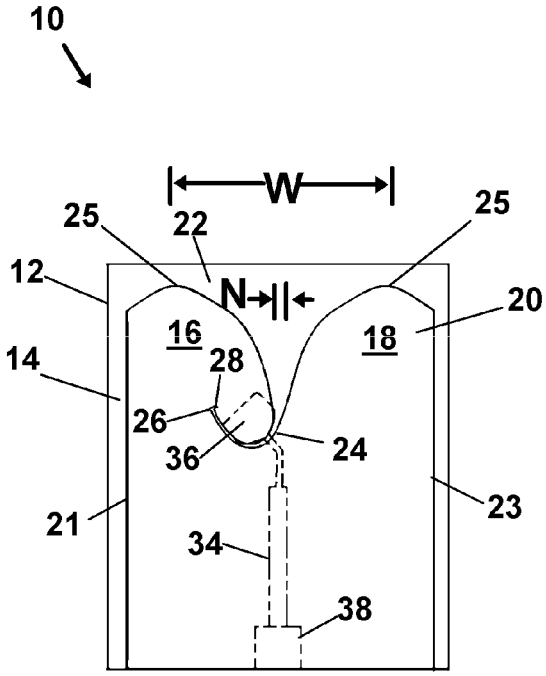
FIG. 3 shows again the front view of the antenna element further depicting the location of the feedline shown by dashed lines in relation to the two lobes or half portions of the element.

Now referring to drawings in FIGS. 1-3, wherein similar components are identified by like reference numerals, there is seen in FIG. 1 a front view of the antenna element 10. The planar element 10 is formed on a first surface of a substrate 12 which as noted is non-conductive and may be constructed of either a rigid or flexible material such as, MYLAR, fiberglass, REXLITE, polystyrene, polyamide, TEFLON fiberglass, or any other such material which would be suitable for the purpose intended.

Generally, the antenna element 10 is shaped with two protruding half portions depicted as lobes 16 and 18 formed to be substantially identical or mirror images of each other.

A first surface 14 of the substrate shown is coated with a conductive material by micro stripline or the like or other metal and substrate construction well known in this art. Any means for affixing the planar conductive material cut to the appropriate shape to form the lobes, to the substrate, is acceptable to practice this invention.

The conductive material 20 as for example, includes but is not limited to aluminum, copper, silver, gold, platinum or any other electrically conductive material which is suitable for the purpose intended. As shown in FIG. 1 the surface conductive material 20 on first surface 14 is etched away, removed by suitable means or left uncoated in the coating process to form the two half portions a first lobe 16 and second lobe 18 and having a mouth 22 defined by end points 25 located on a cavity edge 29 of each lobe. The cavity declines in width leading to a curvilineal portion 24*a* of the formed cavity 24 extending from the narrowest portion of the cavity 24 where the two cavity edges 29 are closest, at a mid point between the two end points 25.

The cavity 24 extending from the mouth 22 has a widest point "W" as noted adjacent a line running between the end points 25 located on the cavity edge 29 of both respective lobes 16 and 18. The cavity 24 declines in width to a narrowest point "N" of separation between the two cavity edges 29, which is substantially equidistant between the two distal end points 25, at a point positioned along an imaginary line substantially perpendicular to the first line extending along the widest point "W" running between the two distal end points 25 on the two lobes 16 and 18.

The widest distance "W" of the mouth 22 portion of the cavity 24 running between the distal end points 25 of the element halves or lobes 16 and 18, determines the low point for the frequency range of the antenna elements 10. The narrowest distance "N" of the mouth 22 portion of the cavity 24 between the two lobes 16 and 18 determines the highest frequency to which the antenna element 10 is adapted for use.

Particularly preferred are angled linear sections 27 extending in a substantially straight line between the end points defining the widest distance 25 of the mouth 22 portion, and first ends of opposing linear parallel side edges 21 and 23 which are located closest to a first side 41 of the substrate. In experimentation the substantially linear side edges 21 and 23, were found to enhance reception in all frequencies and particularly those in proximity to the lowest frequency determined by the distance between the two end points 25 on the cavity edges 29 of the lobes 16 and 18.

The cavity edges 29 of both lobes 16 and 18, may also descend in differing declining angles along sections of the cavity edges 29 of both lobes 16 and 18, from respective said end points 25. As shown, a first section 29*a* the cavity edge 29 of both lobes, in opposing positions, at a first declining angle toward the narrowest separation "N" which is less than the steeper angle a second section 29*b* of the cavity edge 29 extending between the end of the first section 29*a*, and the narrowest separation "N" between the two opposing cavity edges 29. This change in the angular decline of the cavity edge 29 has shown in experimentation to provide better gain in the lower frequencies received by the antenna element 10 and is preferred.

The element can be employed in a vertical or horizontal disposition at an angle to the RF signals adapted for horizontal or vertical polarization of received and/or transmitted RF signals. It may also be employed in a plurality of elements formed in the device 10 herein, in a perpendicular disposition of vertically disposed and horizontally disposed elements, to send and receive RF signals in multiple polarizations and/or to and from multiple directions.

Of course, those skilled in the art will realize that by adjusting the widest and narrowest distances of the formed cavity, the element may be adapted to other frequency ranges and any antenna element which employs two substantially identical leaf portions to form a cavity therebetween with maximum and minimum widths is anticipated within the scope of the claimed device herein.

The cavity 24 formed by the void in the conductive material forming the lobes 16 and 18, proximate to and extending past the narrowest distance "N", of the cavity 24 defined by the internal cavity edge 29 of both lobes 16 and 18 as shown in FIG. 1, curves into the body portion of one lobe, such as the first lobe 16, in a curvilineal portion 24*a*, and extends away from the other lobe 18. The cavity 24 extends to a distal end 26 within the first lobe 16 where it makes a short right angled extension 28 away from the centerline of the curving cavity 24 and toward the centerline of the mouth 22. This short angled extension 28 has shown improvement in gain for some of the frequencies and also an adjustment of the extension 28 size and/or the curving cavity 24 area, which provides a means for impedance matching for antenna element 10 to the wire or line attached thereto.

Beyond impedance improvements, the shape of the disclosed antenna element 10, in experimentation has yielded increased signal gain for both transmission and reception of RF signals evenly across the wide bandwidth between the highest and lowest frequencies in which the antenna device 10 may be configured to be employed, well beyond multiple other shapes, which while similar in appearance, lacked the even signal reception and transmission qualities throughout the entire bandwidths.

Consequently, the disclosed shape and configuration, with the elongated linear opposing sides 21 and 23 and the linear sections 27 communicating from first ends of those sides 21 and 23 with the end points 25 on the cavity edge 29 of both lobes 16 and 18 defining the widest distance "W" of the formed mouth 22, is as such preferred. This is due to this marked increase in an even manner of RF gain across the entire spectrum covered by the antenna element 10 depicted herein.

Additional means for impedance matching is accomplished by the provision additional conductive material 20 employed immediately below the lobes 16 and 18 furthest point of extension of the curve of the curvilineal area 24*a* running between the lobes 16 and 18 shown in the figure as a substantially rectangular box-end surface area 30 extending from below the curvilineal area 24 toward the second end 43 of the substrate. This area 30 shares opposing linear parallel side edges 21 and 23 that extend from first ends on the outside of the lobes 16 and 18, to second ends at bottom right angled corners 31, 33.

The additional area 30 of coated conductive material 20 has shown in experimentation to provide means for impedance matching of the antenna element 10 when the dimensions change to a wider or narrower mouth 22 and declining cavity 24, by allowing adjustment of the relationship or ratio of total conductive surface area 20, (including both lobes 16, 18 and additional area 30) to the remaining non-conductive surface area of the first surface 14, of the substrates 12 and provide ability to match the final form of the element 10 for the frequencies desired, to the impendence of the attached line communicating with a transceiver.

On the opposite surface 32 of the substrate 12 is shown in FIG. 2 a preferred mode where a feedline 34 and feedpad 36 extend in shape and in a position mirroring a peninsula area 31 of the first lobe 16, defined by the curvilineal portions 24 of the cavity 24, where the cavity edge 29 defining one side of the first lobe 16, curves in a U-shape to form the peninsula area 31 of the first lobe 16. Shown in FIG. 1, this peninsula area 31 is within the first lobe 16 between the cavity edge 29 on a first side within the mouth 22 of the antenna, and, the extension of the cavity edge 29, where it has curved into the first lobe 16 in a position opposite the edge 29 area within the mouth 22.

The location of the feedpad 36 and feedline 34 connection, the size and shape of the two lobes 16 and 18 of the antenna element 14, the size and shape of the additional surface area 30 of conductive material 20, and the cross sectional area of the widest distance "W" and narrowest distance "N" of the cavity 28 may be of the antenna designers choice for best results for a given user and frequency. However, because the antenna elements 10 perform so well and across such a wide bandwidth, with even RF gain throughout, the current mode of the antenna element 10, as depicted herein, with the connection point shown, is especially preferred. As can further be seen in the figure, the feedline 34 extends to a terminating end electrically connected to an input/output port, such as a coaxial connector 38 for a connecting wire for a transmitter or receiver, the impendence of which is preferably matched.

To better understand the location and orientation of the feedline 34 and feedpad 36 relative to the cavity 24, another top plan view of the first surface 12 is seen in FIG. 3 with the feedline 34 and feedpad 36 engaged on the second surface 32 depicted by a dashed line.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A broadband antenna element comprising:

a substrate;

a portion of a first planar surface of said substrate being covered with a conductive material and a portion of which being uncovered;

said conductive material forming an antenna element having two lobes positioned on opposite sides of a cavity therebetween;

said cavity defined by respective opposing cavity edges of said two lobes of said antenna element;

said cavity having a widest portion extending along an imaginary first line between respective opposing end points, said end points located at respective positions upon said opposing said cavity edges of both said lobes;

said lobes each having respective side edges opposite a respective said cavity edge thereof, said side edges extending from respective first ends closest to a first side of said substrate, to respective second ends closest to a second side of said substrate opposite said first side of said substrate;

angled linear portions of each respective cavity edge extending between a respective said end point, and respective said first ends of each respective said side edge of said lobes;

said cavity having a cross section diminishing in size from a widest point adjacent said line running between said endpoints, to a narrowest point of separation between said cavity edges, said narrowest point positioned substantially equidistant between said end points along an imaginary second line intersecting and perpendicular to said imaginary first line;

said cavity extending in a curved portion from said narrowest point of separation and into one of said lobes; and a feed line positioned on a second planar surface of said substrate on an opposite side of said substrate from said first planar surface, said feed line being electrically connected to the conductive material of one of said two lobes of said antenna element.

2. The broadband antenna element of claim 1, additionally comprising:

said first ends of each respective said side edge of said lobes being located a distance from said second end of said substrate, between said first imaginary line, and said second of said substrate; and said distance determining an angle of both said linear portions communicating between their respective intersection with said endpoints, and respective first ends, of the respective side edges of said first and second lobes.

3. The broadband antenna element of claim 2, additionally comprising:

first portions of said respective opposing cavity edges extending at a first declining angle toward said narrowest point of separation, from respective said end points on each respective said lobe, to a beginning point of respective opposing second portions of said opposing cavity edges;

said respective second portions of said respective opposing cavity edges extending from respective said beginning points toward said narrowest point of separation at a second declining angle;

said second declining angle being greater than said first declining angle; and whereby gain in lowest frequencies received and transmitted by said element are enhanced.

* * * * *